US005104615A

United States Patent [19]

Aiura et al.

[11] Patent Number: 5,104,615

[45] Date of Patent: Apr. 14, 1992

[54] PRECISION MACHINABLE ALUMINUM MATERIAL

[75] Inventors: Tadashi Aiura; Osamu Takezoe, both of Shimonoseki, Japan

[73] Assignee: Kabushiki Kaisha Kobe Seiko Sho, Kobe, Japan

[21] Appl. No.: 514,942

[22] Filed: Apr. 26, 1990

[51] Int. Cl.[5] ..... C22C 21/04

[52] U.S. Cl. ..... 420/544; 148/440; 420/543; 420/546; 420/548

[58] Field of Search ..... 420/534, 537, 546, 548, 420/535, 543, 544; 148/440, 437

[56] References Cited

U.S. PATENT DOCUMENTS 4,377,425 3/1983 Otani et al. ..... 420/543

FOREIGN PATENT DOCUMENTS 55-125254 9/1980 Japan ..... 420/543
60-184658 9/1985 Japan ..... 420/543
61-104044 5/1986 Japan ..... 420/535

*Primary Examiner*—R. Dean
*Assistant Examiner*—Robert R. Koehler
*Attorney, Agent, or Firm*—Oblon, Spivak, McClelland, Maier & Neustadt

[57] ABSTRACT

An aluminum material suitable for forming the substrate of a photoconductor, such as a photoconductive drum, for electrophotographic copying machine, capable of being satisfactorily mirror-finished by precision machining. The Ti content of the aluminum material is less than 0.008% by weight. The aluminum material contains at least one of Mg, Si and Mn. The Mg content, Si content and Mn content of the aluminum material are in the range of 0.1 to 5.0% by weight, in the range of 0.1 to 1.0% by weight and in the range of 0.1 to 1.5% by weight, respectively.

1 Claim, No Drawings

PRECISION MACHINABLE ALUMINUM MATERIAL

BACKGROUND OF THE INVENTION

1. Field of the Invention

The present invention relates to a precision-workable aluminum material suitable for forming the substrate of a photoconductor for an electrophotographic copying machine and, more particularly, to a precision-workable aluminum material for forming a photoconductor having excellent properties allowing satisfactory formation of a film thereon and mirror-finish machining, and capable of being finished to form a surface with few minute machining defects.

2. Description of the Prior Art

Recent electrophotographic copying machines are provided with a photoconductor of an improved quality having improved characteristics. The use of photoconductor as a photoconductive material has improved the quality of images formed on the photoconductor remarkably. With such improvements in view, qualitative requirements of substrates for carrying a photoconductive material, such as the body of a photoconductive drum, have become very severe.

To form substrates meeting such severe qualitative requirements, efforts have been made to reduce surface defects in the mirror-finished substrates by forming the substrates of aluminum or an aluminum alloy (which will be designated inclusively as "aluminum material" hereinafter) having a high purity and the least possible content of Fe containing compounds and Mn containing metal compounds. Tools capable of burnishing the surface of aluminum substrates have been developed for finishing the surface of aluminum substrates.

These measures have eliminated surface defects in the substrate attributable to the crystals of Fe containing metal compounds and Mn containing metal compounds contained in an aluminum material forming the substrate. Those measures, however, are unable to eliminate a problem that the surface of the substrate is liable to be roughened by machining. Even the burnishing tool is unable to prevent surface roughening, and any currently available tool is unable to prevent perfectly surface defects including surface roughening in the substrate formed of an aluminum material.

SUMMARY OF THE INVENTION

Accordingly, it is an object of the present invention to provide a precision-workable aluminum material capable of being machined to provide a finished surface free from surface defects including surface roughening.

To achieve the object, the present invention provides a precision-workable aluminum material having a Ti content not greater than 0.008% by weight.

An aluminum material having a Ti content not greater than 0.008% by weight prevents the production of Ti containing metal compounds and hence a substrate formed of an aluminum material in accordance with the present invention is capable of being finished by precision machining, capable of allowing the formation of a satisfactory photoconductive film and free from minute surface defects. Thus, the aluminum material in accordance with the present invention can be used profitably for forming a substrate for the photoconductor of an electrophotographic copying machine.

The above and other objects, features and advantages will become more apparent from the following description.

DESCRIPTION OF THE PREFERRED EMBODIMENTS

The maximum Ti content of an aluminum material in accordance with the present invention is limited to 0.008% by weight (80 ppm). The present invention has been made on the basis of a knowledge that surface roughening in machining a work formed of an aluminum material is attributable to Ti containing metal compounds contained in the aluminum material and that reduction in Ti containing metal compounds in an aluminum material forming the substrate of a photoconductor is essential to the qualitative improvement of the substrate of the photoconductor. It was found through experiments that the reduction of the Ti content below 80 ppm prevents surface defects in a work formed of an aluminum material attributable to Ti containing metal compounds.

Generally, the Ti content of industrial aluminum materials is in the range of 30 to 100 ppm. In heat-treating a work formed on an aluminum material, the work is contaminated to increase its Ti content to a value in the range of 30 to 150 ppm. Accordingly, an aluminum material having an allowable Ti content must be selected, and the equipments of the manufacturing process, such as filters, must carefully be managed to prevent the contamination of the work with Ti so that the Ti content of the aluminum material forming the work is not greater than 80 ppm to prevent surface defects in the work formed in machining the work.

Preferably, an aluminum material in accordance with the present invention contains at least one of Mg, Si and Mn. The tensile strength of the aluminum material is preferably about 10 kg/mm$^2$ or above to mirror-finish a work formed of the aluminum material by machining. Therefore it is preferable to increase the tensile strength of the aluminum material by adding a strengthening element, such as Mg, Si or Mn, to the aluminum material.

When Mg is used as a strengthening additive, Mg content must be in the range of 0.1 to 5.0% by weight because a Mg content less than 0.1% by weight has no effect on strengthening and a Mg content exceeding 5.0% by weight deteriorates the workability of the aluminum material.

When Si is used as a strengthening additive, Si content must be in the range of 0.1 to 1.0% by weight because a Si content less than 0.1% by weight has no effect on strengthening and a Si content exceeding 1.0% by weight deteriorates the corrosion resistance of the aluminum material.

When Mn is used as a strengthening additive, Mn content must be in the range of 0.1 to 1.5% by weight because a Mn content less than 0.1% by weight has no effect on strengthening and a Mn content exceeding 1.5% by weight coarsens crystalline grains adversely affecting the finished surface of a work formed of the aluminum material.

The present invention will be described in detail hereinafter.

Examples 1 to 5 in accordance with the present invention and Controls 1 to 5 were prepared by processing aluminum materials respectively having compositions tabulated in Table 1.

TABLE 1

| | Composition (% by weight) | | | | | | |
|---|---|---|---|---|---|---|---|
| | Mg | Mn | Si | Ti | Cr | Zr | Al |
| Example 1 | — | — | — | 0.004 | 0.01 | 0.1 | Remainder |
| Example 2 | 2.5 | — | — | 0.003 | — | — | " |
| Example 3 | 0.5 | — | 0.25 | 0.004 | — | — | " |
| Example 4 | — | 1.0 | — | 0.004 | — | — | " |
| Example 5 | 0.8 | 0.8 | — | 0.003 | — | — | " |
| Control 1 | — | — | — | 0.1 | 0.01 | 0.1 | " |
| Control 2 | 0.5 | — | 0.5 | 0.05 | — | — | " |
| Control 3 | 2.5 | — | — | 0.04 | — | — | " |
| Control 4 | — | 1.0 | — | 0.15 | — | — | " |
| Control 5 | 0.5 | 0.5 | — | 0.1 | — | — | " |

Billets of the aluminum materials were subject to hot extrusion to form pipes of 50 mm in outside diameter, 4 mm in wall thickness and 250 mm in length. The aluminum materials for Control 2, 3 and 4 are aluminum alloys specified respectively in JIS 6063, 5052 and 3003.

The surfaces of the pipes were finished by precision machining in a surface roughness ($R_{max}$) of 0.1 μm under the following machining conditions.

| | |
|---|---|
| Tool: | Natural diamond tool |
| Feed rate: | 0.1 mm/revolution |
| Depth of cut: | 0.1 mm |
| Revolving speed: | 1600 rpm |

The surfaces of Examples 1 to 5 and Controls 1 to 5 thus finished by precision machining were observed for surface defects with a dark field microscope. Each pipe was machined ten times and its surface was observed after each machining to count the number of surface defects. Ten sets of the number of surface defects were averaged to obtain a mean number of defects for each pipe. In observing a surface in a dark field, a light beam is projected on the surface at an acute angle to the surface, and the objective lens is disposed with its optical axis perpendicular to the surface to receive light reflected by the surface. Since the light falling on a normally mirror-finished area is not reflected toward the objective lens while the light falling on defective area, namely, defects in the surface, is scattered by irregular reflection, the defects in the surface can be found.

The results of observation of the surfaces of the pipes are shown in Table 2.

As is obvious from Table 2, Controls 1 to 5 having Ti contents exceeding 0.008% by weight have defects, and the number of defects increases with Ti content.

On the other hand, no defect was found in Examples 1 to 5, which proved that the pipes of Examples 1 to 5 in accordance with the present invention can be used very profitably as the substrate of a photoconductor.

TABLE 2

| | Mean number of defects | Rating |
|---|---|---|
| Example 1 | 0 | Good |
| Example 2 | 0 | Good |
| Example 3 | 0 | Good |
| Example 4 | 0 | Good |
| Example 5 | 0 | Good |
| Control 1 | 3 | Bad |
| Control 2 | 1 | Bad |
| Control 3 | 2 | Bad |
| Control 4 | 4 | Bad |
| Control 5 | 3 | Bad |

As is apparent from the foregoing description, the aluminum material in accordance with the present invention can very profitably be used for forming the substrate of a photoconductor for electrophotographic copying machine.

What is claimed is:

1. A precision-workable aluminum material consisting essentially of:

Mg 0.1 to 1.0% by weight
Si 0.1 to 0.5% by weight
Ti 0.003 to 0.004% by weight
Al balance.

* * * * *